US011359819B2

(12) United States Patent
Cadima

(10) Patent No.: US 11,359,819 B2
(45) Date of Patent: Jun. 14, 2022

(54) GAS BURNER WITH A WIRED TEMPERATURE SENSOR

(71) Applicant: Haier US Appliance Solutions, Inc., Wilmington, DE (US)

(72) Inventor: Paul Bryan Cadima, Crestwood, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 314 days.

(21) Appl. No.: 16/585,217

(22) Filed: Sep. 27, 2019

(65) Prior Publication Data

US 2021/0095853 A1 Apr. 1, 2021

(51) Int. Cl.
*F24C 3/08* (2006.01)
*F24C 15/10* (2006.01)

(52) U.S. Cl.
CPC ..... *F24C 3/085* (2013.01); *F24C 15/107* (2013.01); *F23N 2225/16* (2020.01)

(58) Field of Classification Search
CPC ..... F24C 15/107; F23N 2225/16
USPC ..... 126/42, 39 R, 39 N, 39 K, 39 J, 39 E
See application file for complete search history.

(56) References Cited

U.S. PATENT DOCUMENTS

| | | | | |
|---|---|---|---|---|
| 3,100,995 | A * | 8/1963 | Woodward | G01K 1/143 374/141 |
| 2002/0088640 | A1* | 7/2002 | Schuh | G01K 1/026 174/117 M |
| 2020/0022527 | A1* | 1/2020 | Chen | A47J 31/02 |
| 2020/0182476 | A1* | 6/2020 | Bentley | A47J 27/62 |

FOREIGN PATENT DOCUMENTS

| | | | |
|---|---|---|---|
| CN | 207936129 | U | 10/2018 |
| JP | 2011075261 | A | 4/2011 |
| KR | 101802776 | B1 | 12/2017 |

* cited by examiner

*Primary Examiner* — Vivek K Shirsat
(74) *Attorney, Agent, or Firm* — Dority & Manning, P.A.

(57) ABSTRACT

A gas burner assembly includes a gas burner. A grate with a plurality of fingers is positioned above the gas burner. A sensor finger of the plurality of fingers defines an open downward facing slot at a bottom of the sensor finger. A temperature sensor is mounted to the sensor finger at a first end portion of the slot. A pogo pin terminal block is mounted to the grate at a second end portion of the slot. A wire extends between the temperature sensor and the pogo pin terminal block within the slot.

19 Claims, 6 Drawing Sheets

GAS BURNER WITH A WIRED TEMPERATURE SENSOR

FIELD OF THE INVENTION

The present subject matter relates generally to gas burners for appliances.

BACKGROUND OF THE INVENTION

Gas cooktop appliances generally include a plurality of gas burners mounted at a top surface of the appliance. Gas burners heat a cooking utensil positioned on a grate over the gas burner primarily via convective heating. Thus, measuring cooking utensil temperatures on gas cooktop appliances poses challenges because any sensor that contacts the cooking utensil is significantly heated by swirling heated air from the gas burner.

Some gas cooktops include a spring-loaded sensor that passes through the gas burner and presses against the cookware on the grate. Such spring-loaded sensors have drawbacks. For example, assembly and cleaning of burner parts is greatly complicated due to the construction of the gas burner that includes a moveable sensor passing through the gas burner. As another example, openings in the gas burner and other cooktop components that accommodate the spring-loaded sensors undesirably pass spills through the gas burner.

BRIEF DESCRIPTION OF THE INVENTION

Aspects and advantages of the invention will be set forth in part in the following description, or may be apparent from the description, or may be learned through practice of the invention.

In an example embodiment, a gas burner assembly includes a gas burner. A grate with a plurality of fingers is positioned above the gas burner. A sensor finger of the plurality of fingers defines an open downward facing slot at a bottom of the sensor finger. A temperature sensor is mounted to the sensor finger at a first end portion of the slot. A pogo pin terminal block is mounted to the grate at a second end portion of the slot. A wire extends between the temperature sensor and the pogo pin terminal block within the slot.

In another example embodiment, a cooktop appliance includes a top panel. A gas burner is positioned on the top panel. A grate is also positioned on the top panel. The grate has a plurality of fingers positioned above the gas burner. A sensor finger of the plurality of fingers defines an open downward facing slot at a bottom of the sensor finger. A temperature sensor is mounted to the sensor finger at a first end portion of the slot. A first pogo pin terminal block is mounted to the grate at a second end portion of the slot. A tubular sheath is positioned within the slot. The tubular sheath extends between the temperature sensor and the pogo pin terminal block. A wire extends through the tubular sheath between the temperature sensor and the pogo pin terminal block. A second pogo pin terminal block is positioned on the top panel. The second pogo pin terminal block on the top panel is connected to the first pogo pin terminal block on the grate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 is a top, plan view of a cooktop appliance according to an example embodiment.

DETAILED DESCRIPTION

Figure 7:
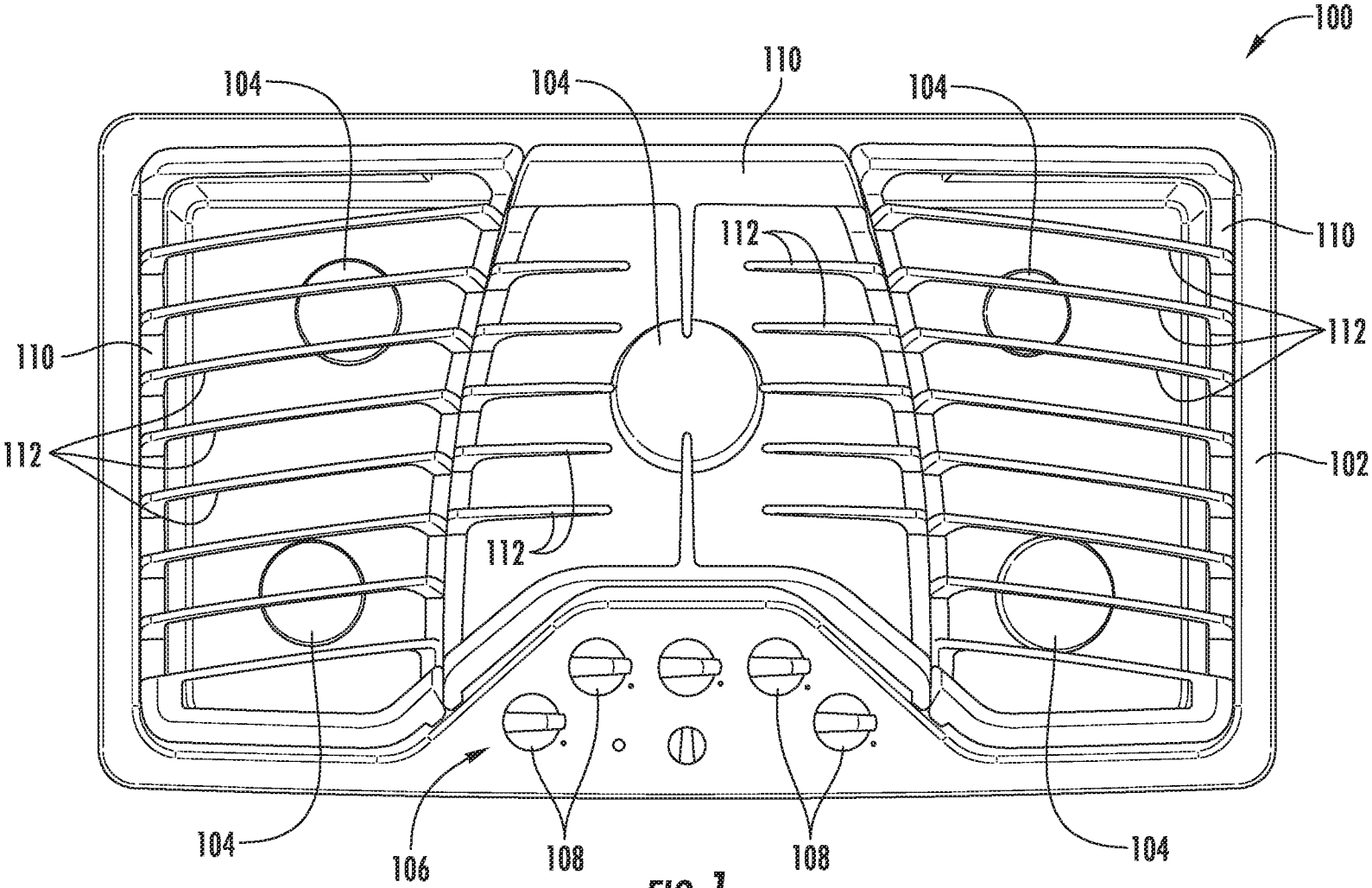

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner assembly described below may be used on other types of cooking appliances, such as single or double oven range appliances. Cooktop appliance 100 is used in the discussion below only for the purpose of explanation, and such use is not intended to limit the scope of the present disclosure to any particular style of cooktop appliance.

FIG. 1 illustrates an example embodiment of a cooktop appliance 100 of the present disclosure. Cooktop appliance 100 may be, e.g., fitted integrally with a surface of a kitchen counter or may be configured as a slide-in cooktop unit. Cooktop appliance 100 includes a top panel 102 with one or more heating sources, such as heating elements 104 for use in, e.g., heating or cooking. In general, top panel 102 may be constructed of any suitably rigid and heat resistant material capable of supporting heating elements 104, cooking utensils, grates 110, and/or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. For this example embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it will be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

Cooktop appliance 100 is generally referred to as a "gas cooktop," and heating elements 104 are gas burners. For example, one or more of the gas burners in cooktop appliance may be a gas burner assembly 200 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated fingers 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Turning now to FIGS. 2 through 6, a gas burner assembly 200 according to an example embodiment of the present disclosure is described. Gas burner assembly 200 may be used in cooktop appliance 100, e.g., as one of heating elements 104. Thus, gas burner assembly 200 is described in greater detail below in the context of cooktop appliance 100. However, it will be understood that gas burner assembly 200 may be used in or with any other suitable cooktop appliance in alternative example embodiments.

Figure 2:
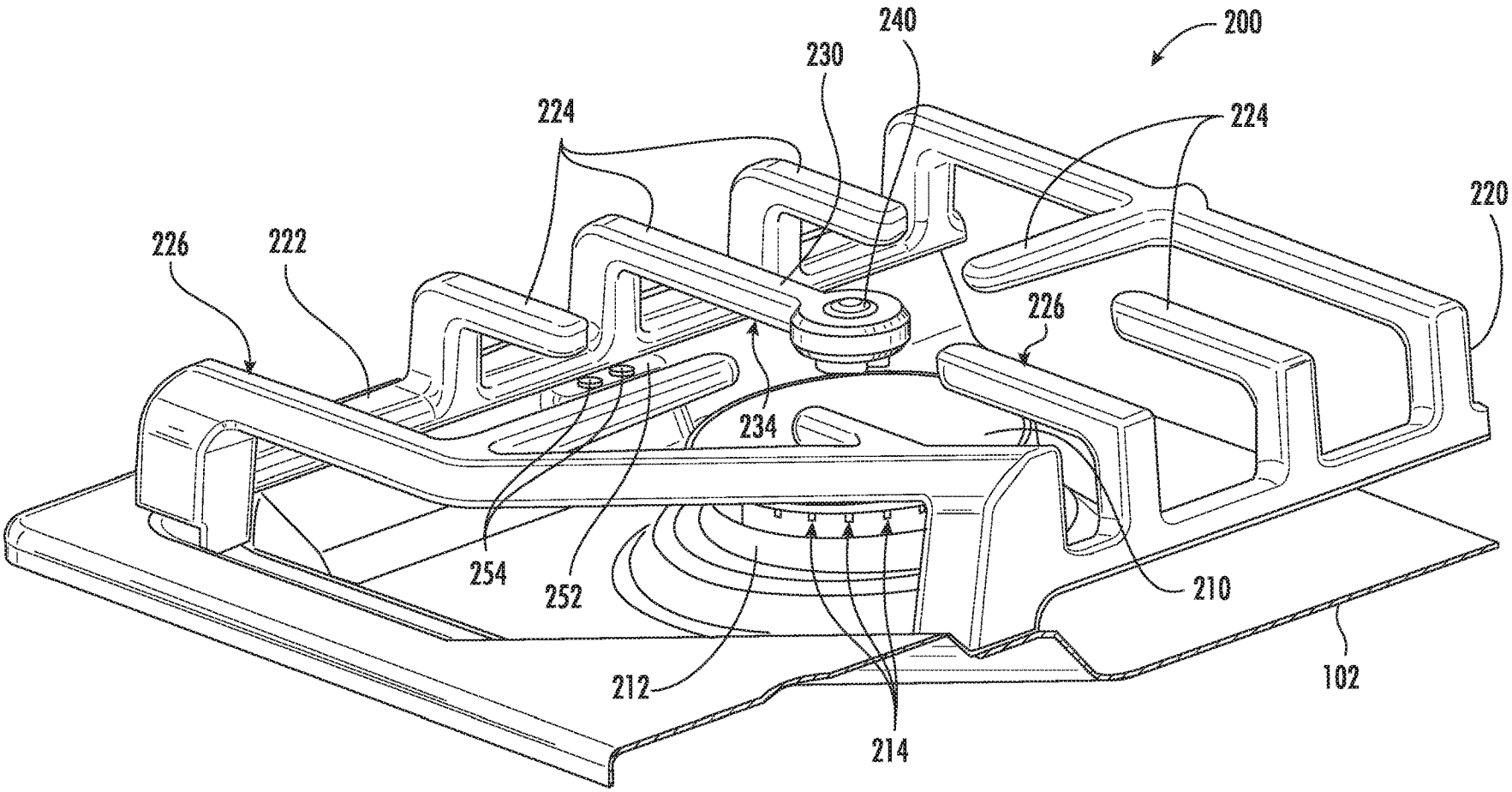
FIG. 2 is a perspective view of a gas burner assembly according to an example embodiment.

Gas burner assembly 200 includes a gas burner 210. Gas burner 210 may include a burner body 212 that defines a plurality of flame ports 214. Burner body 212 may be positioned on top panel 102, and burner body 212 may be round such that gas burner 210 is a round gas burner as shown in FIG. 2. A mixture of air and gaseous fuel, such as natural gas, propane, etc., may flow out of burner body 212 at ports 214, and the gaseous fuel and air mixture exiting ports 214 may be ignited to heat a cooking utensil, such as a pot, pan, griddle, etc., positioned above gas burner 210 on a grate 220.

Grate 220 has a base 222 and a plurality of fingers 224. Base 222 may be positioned on top panel 102. Fingers 224 extend from base 222, e.g., upwardly and/or towards gas burner 210. Fingers 224 support a cooking utensil above gas burner 210. For example, the cooking utensil may rest on a top surface 226 of fingers 224 above gas burner 210. Grate 220 may be formed of cast metal, such as cast iron or aluminum, such that base 222 and fingers 224 are formed from a single, seamless piece of metal. Grate 220 is removable from top panel 102, e.g., by lifting upwardly on grate 220.

Figure 3:
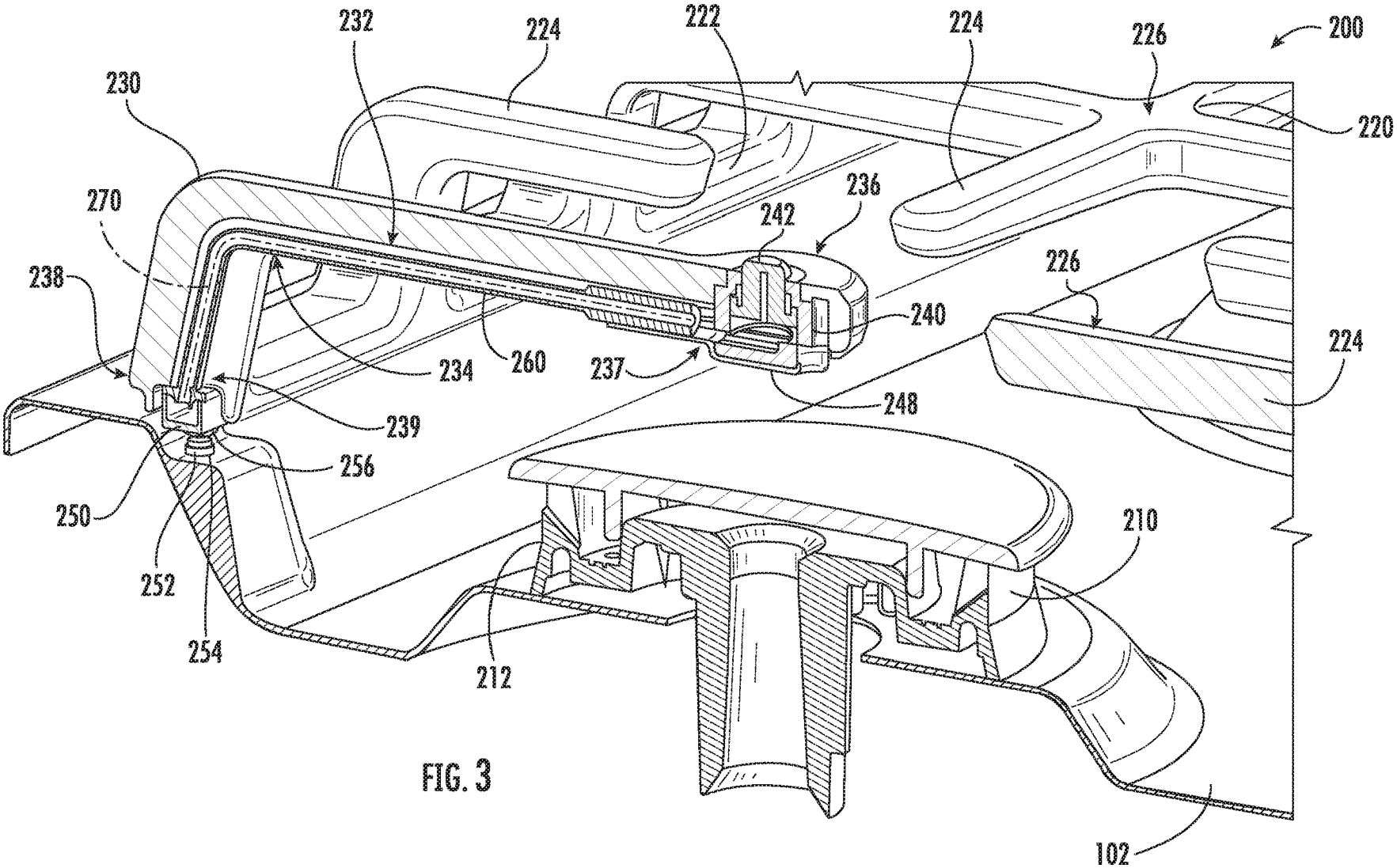
FIG. 3 is a section view of the example gas burner assembly of FIG. 2.
Figure 4:
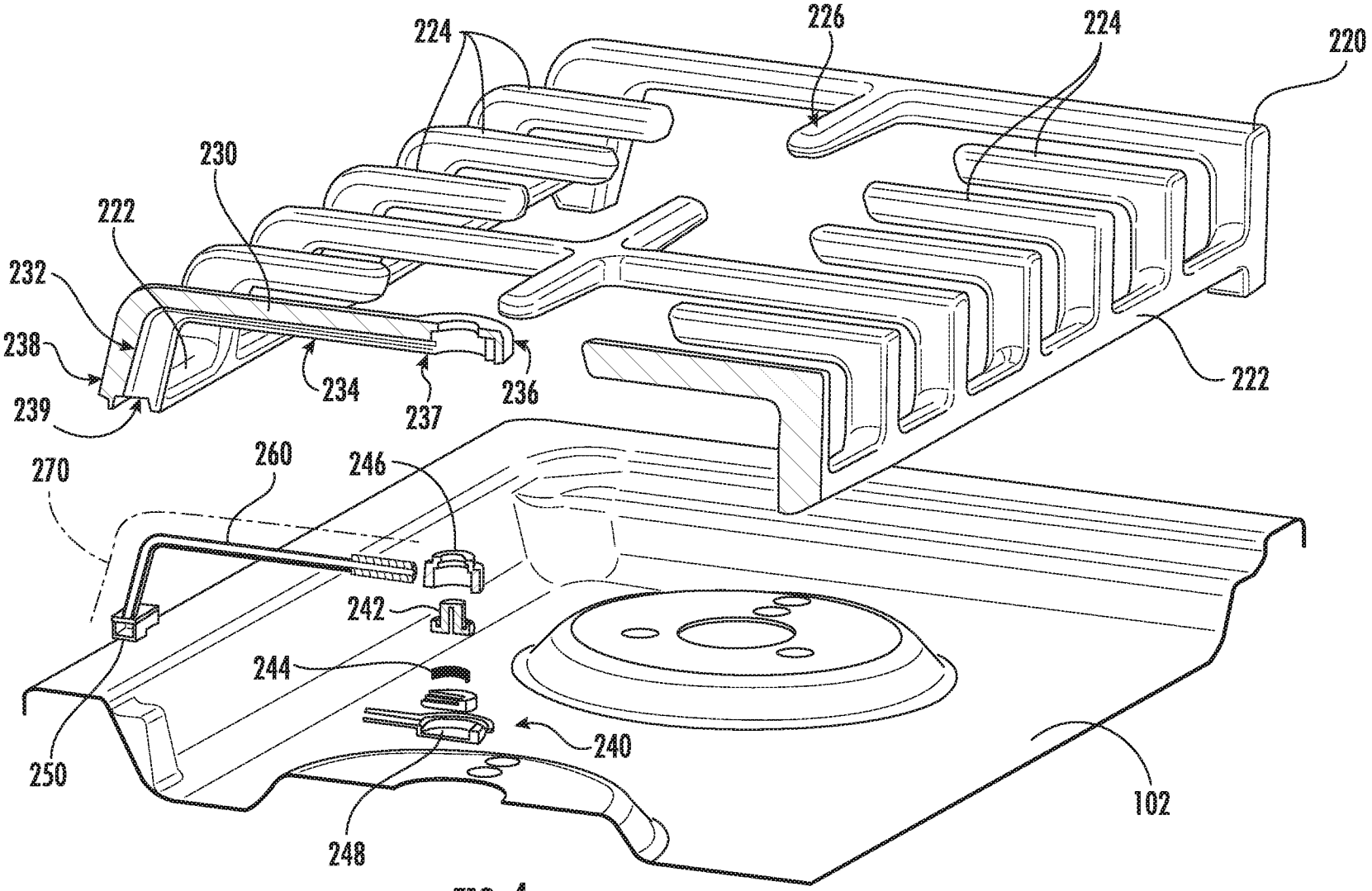
FIG. 4 is an exploded section view of the example gas burner assembly of FIG. 2.
Figure 5:
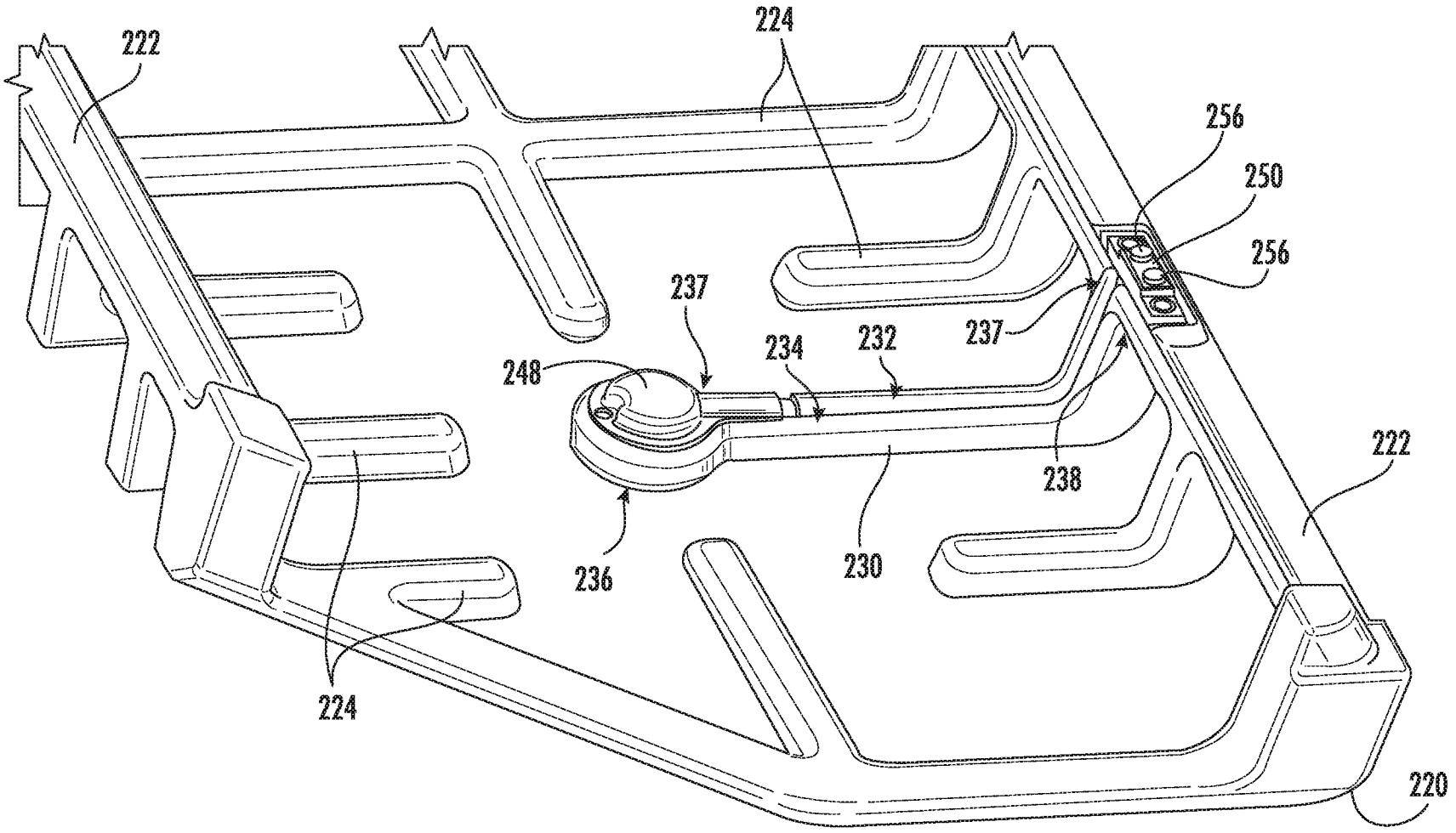
FIG. 5 is a bottom perspective view of a grate of the example gas burner assembly of FIG. 2.

Fingers 224 include a sensor finger 230. As discussed in greater detail below, sensor finger 230 supports a temperature sensor 240 that is operable to measure a temperature of the cooking utensil on grate 220. As shown in FIGS. 3 through 5, sensor finger 230 defines slot 232 at a bottom 234 of sensor finger 230. Slot 232 is open and downwardly facing. Thus, slot 232 is exposed and accessible at bottom 234 of sensor finger 230.

Sensor finger 230 extends between a first end portion 236 and a second end portion 238. In particular, sensor finger 230 may be elongated between first and second end portions 236, 238 of sensor finger 230. Second end portion 238 of sensor finger 230 may be positioned at base 222. Conversely, first end portion 236 of sensor finger 230 is spaced from base 222, e.g., and may be positioned above gas burner 210. Slot 232 may also extend between a first end portion 237 and a second end portion 239. First end portion 237 of slot 232 may be positioned at first end portion 236 of sensor finger 230, and second end portion 239 of slot 232 may be positioned at second end portion 238 of sensor finger 230. Thus, slot 232 may extend along the length of sensor finger 230.

Temperature sensor 240 is mounted to sensor finger 230. For example, temperature sensor 240 may be positioned at first end portion 236 of sensor finger 230 and/or first end portion 237 of slot 232. For example, temperature sensor 240 may be positioned over gas burner 210 on sensor finger 230. In particular, temperature sensor 240 may be positioned concentric with gas burner 210 on sensor finger 230. Thus, temperature sensor 240 may be positioned on sensor finger 230 such that temperature sensor 240 is operable to measure and/or detect the temperature of a cooking utensil on grate 220. Temperature sensor 240 may be a resistance temperature detector, a thermocouple, an infrared temperature sensor, a bimetallic switch, etc.

Figure 6:
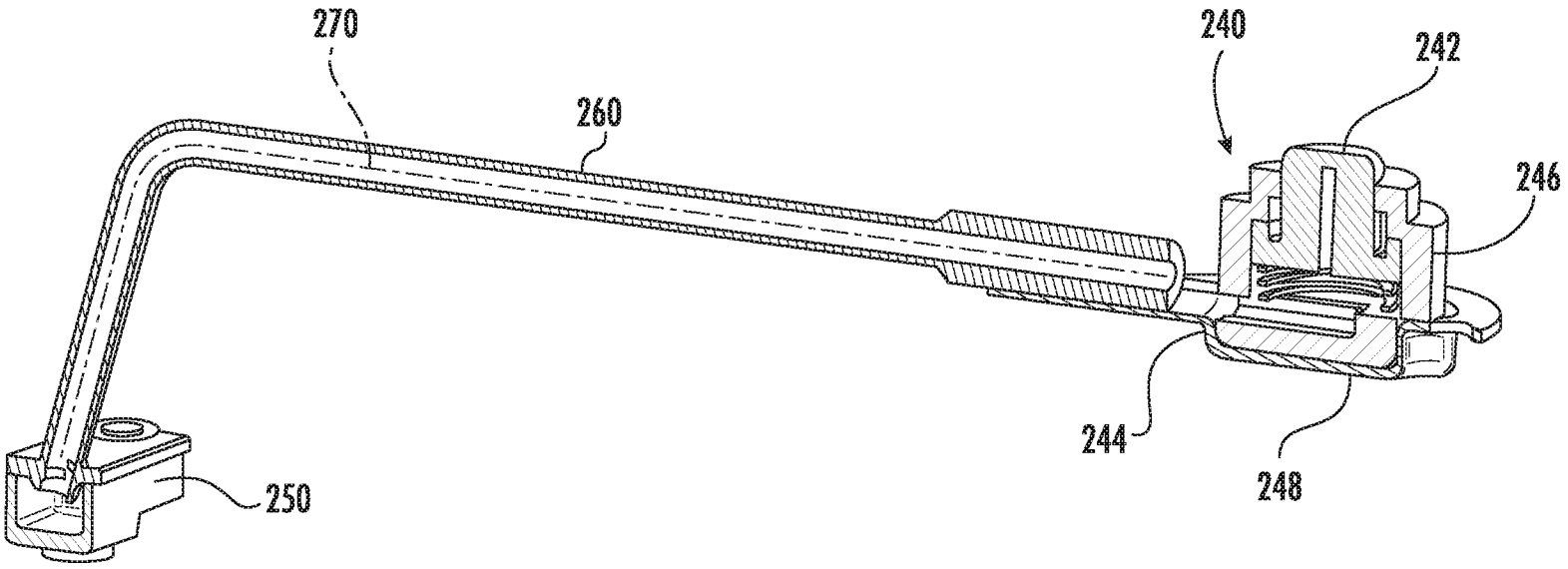
FIG. 6 is a section view of certain components of the example gas burner assembly of FIG. 2.

As shown in FIGS. 4 and 6, temperature sensor 240 may include a probe 242, a spring 244, a casing 246, and a cover 248. Probe 242 may be coupled to spring 244, and probe 242 is urged upwardly, e.g., towards a utensil on grate 220, by spring 244. Probe 242 and spring 244 may be positioned within casing 226, and casing 226 may be mounted to sensor finger 230. Cover 248 may also be mounted to sensor finger 232 at bottom 234 of sensor finger 230. Cover 248 may be positioned between probe 242 and gas burner 210. Thus, cover 248 may advantageously shield probe 242 from direct heating by gas burner 210. For example, cover 248 may block direct radiative heat transfer from flames at gas burner 210 and probe 242, and/or cover 248 may shield probe 242 from direct convective heat transfer from air heated by gas burner 210.

Gas burner assembly 200 may also include a first pogo pin terminal block 250 and a second pogo pin terminal block 252. First pogo pin terminal block 250 is mounted to grate 220. First pogo pin terminal block 250 may also be positioned at one or more of base 222, second end portion 238 of sensor finger 230, and second end portion 239 of slot 232. Second pogo pin terminal block 252 is positioned on top panel 102 adjacent grate 220. Second pogo pin terminal block 252 on top panel 102 is connected to first pogo pin terminal block 250 on grate 220, e.g., when grate 220 is positioned on top panel 102 over gas burner 210.

The connection between first and second pogo pin terminal blocks 250, 252 allows signal communication between temperature sensor 240 and control panel 106 or another controller of cooktop appliance 100. Thus, temperature measurements or other suitable control signals may be transmitted from temperature sensor 240 via the connection between first and second pogo pin terminal blocks 250, 252. Each of first and second pogo pin terminal blocks 250, 252 includes a respective one of at least two spring loaded pins 254 and at least two contact pads 256. For example, first pogo pin terminal block 250 may include two contact pads 256, and second pogo pin terminal block 252 may include two spring loaded pins 254. In alternative example embodiments, the relative position of spring loaded pins 254 and contact pads 256 on first and second pogo pin terminal blocks 250, 252 may be reversed.

A tubular sheath 260 is positioned within slot 232, and tubular sheath 260 may extend between temperature sensor 240 and first pogo pin terminal block 250 in slot 232. Tubular sheath 260 may be a metal tubular sheath, such as an aluminum, copper, steel, or other suitable tube.

A wire 270 extends through tubular sheath 260 between temperature sensor 240 and first pogo pin terminal block 250. Wire 270 connects temperature sensor 240 and first pogo pin terminal block 250 to place temperature sensor 240 and first pogo pin terminal block 250 in signal communication with each other. Thus, wire 270 may transmit electrical signals between temperature sensor 240 and first pogo pin terminal block 250. Wire 270 may include a woven fiberglass jacket or a woven steel mesh jacket. Such construction of wire 270 may advantageously limit conductive heat transfer between tubular sheath 260 and wire 270. Thus, wire 270 within tubular sheath 260 may be insulated for high temperatures.

Gas burner assembly 200 advantageously overcomes the drawbacks of known gas burners with spring loaded temperature sensor that extend through the gas burner. Temperature sensor 240 is advantageously positioned proximate cookware on grate 210 yet temperature sensor 240 and wire 270 are also shielded by sensor finger 232 and tubular sheath 260 from direct convective heating by air from gas burner 210. First and second pogo pin terminal blocks 250, 252 also allow grate 220 to be removed from top panel 102 without the need to manually disconnect any wiring. First and second pogo pin terminal blocks 250, 252 may also accommodate variation in positioning of grate 220 on top panel 102 while also maintaining good electrical signal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly, comprising:

a gas burner;

a grate with a plurality of fingers positioned above the gas burner, a sensor finger of the plurality of fingers defining an open downward facing slot at a bottom of the sensor finger;

a temperature sensor mounted to the sensor finger at a first end portion of the slot;

a pogo pin terminal block mounted to the grate at a second end portion of the slot and having at least two contact pads; and a wire extending between the temperature sensor and the pogo pin terminal block within the slot.

2. The gas burner assembly of claim 1, wherein the temperature sensor is positioned over the gas burner on the sensor finger.

3. The gas burner assembly of claim 2, wherein the gas burner is a round gas burner, and the temperature sensor is positioned concentric with the round gas burner on the sensor finger.

4. The gas burner assembly of claim 1, wherein the pogo pin terminal block comprises at least two spring loaded pins.

5. The gas burner assembly of claim 1, further comprising a tubular sheath positioned within the slot, the tubular sheath extending between the temperature sensor and the pogo pin terminal block, the wire extending through the tubular sheath between the temperature sensor and the pogo pin terminal block.

6. The gas burner assembly of claim 5, wherein the tubular sheath is a metal tubular sheath.

7. The gas burner assembly of claim 1, wherein the wire comprises a woven fiberglass jacket or a woven steel mesh jacket.

8. The gas burner assembly of claim 1, wherein the temperature sensor is a resistance temperature detector, a thermocouple, an infrared temperature sensor, or a bimetallic switch.

9. The gas burner assembly of claim 1, wherein the grate is a cast metal grate.

10. The gas burner assembly of claim 1, wherein the slot extends along a length of the sensor finger.

11. A cooktop appliance, comprising:

a top panel a gas burner positioned on the top panel;

a grate positioned on the top panel, the grate having a plurality of fingers positioned above the gas burner, a sensor finger of the plurality of fingers defining an open downward facing slot at a bottom of the sensor finger;

a temperature sensor mounted to the sensor finger at a first end portion of the slot;

a first pogo pin terminal block mounted to the grate at a second end portion of the slot;

a tubular sheath positioned within the slot, the tubular sheath extending between the temperature sensor and the pogo pin terminal block;

a wire extending through the tubular sheath between the temperature sensor and the pogo pin terminal block; and a second pogo pin terminal block positioned on the top panel, the second pogo pin terminal block on the top panel connected to the first pogo pin terminal block on the grate.

12. The cooktop appliance of claim 11, wherein the temperature sensor is positioned over the gas burner on the sensor finger.

13. The cooktop appliance of claim 12, wherein the gas burner is a round gas burner, and the temperature sensor is positioned concentric with the round gas burner on the sensor finger.

14. The cooktop appliance of claim 11, wherein each of the first and second pogo pin terminal blocks comprises a respective one of at least two spring loaded pins and at least two contact pads.

15. The cooktop appliance of claim 11, wherein the tubular sheath is a metal tubular sheath.

16. The cooktop appliance of claim 11, wherein the wire comprises a woven fiberglass jacket or a woven steel mesh jacket.

17. The cooktop appliance of claim 11, wherein the temperature sensor is a resistance temperature detector, a thermocouple, an infrared temperature sensor, or a bimetallic switch.

18. The cooktop appliance of claim 11, wherein the grate is a cast metal grate.

19. The cooktop appliance of claim 11, wherein the slot extends along a length of the sensor finger.

* * * * *